211-205 SR
10/22/85 OR 4,548,328

United States Patent [19]

Bräuning

[11] Patent Number: 4,548,328

[45] Date of Patent: Oct. 22, 1985

[54] CLOTHES STAND

[75] Inventor: Egon Bräuning, Weil am Rhein, Fed. Rep. of Germany

[73] Assignee: Protoned B.V., Amsterdam, Netherlands

[21] Appl. No.: 385,174

[22] Filed: Jun. 4, 1982

[30] Foreign Application Priority Data

Jul. 10, 1981 [CH] Switzerland ..... 4553/81

[51] Int. Cl.[4] ..... A47F 5/00

[52] U.S. Cl. ..... 211/205; 211/123

[58] Field of Search ..... 211/205, 206, 123, 45, 211/105.1, 193, 204

[56] References Cited

U.S. PATENT DOCUMENTS

| | | | |
|---|---|---|---|
| 2,868,389 | 1/1959 | Friend | 211/123 |
| 2,895,618 | 7/1959 | Nathan | 211/123 |
| 3,481,483 | 12/1969 | Harvey et al. | 211/123 X |
| 3,984,002 | 10/1976 | Howard | 211/45 |
| 3,991,884 | 11/1976 | De Maagd et al. | 211/123 X |
| 4,361,241 | 11/1982 | Stoddard | 211/45 X |

*Primary Examiner*—Robert W. Gibson, Jr.
*Attorney, Agent, or Firm*—Ladas & Parry

[57] ABSTRACT

Each of the carrying arms (4) of the clothes stand carries on its top side a covering (5, 13) which is connected in a slip-proof manner to the carrying core profile of the carrying arm. This covering is provided over some of its top side with a comb-like bearing portion (14) with a number of comb teeth (15) and with grooves (17) which lie between the teeth (15) and which are oblique to the longitudinal axis (16) of the supporting arm (4).

1 Claim, 8 Drawing Figures

Fig. 2
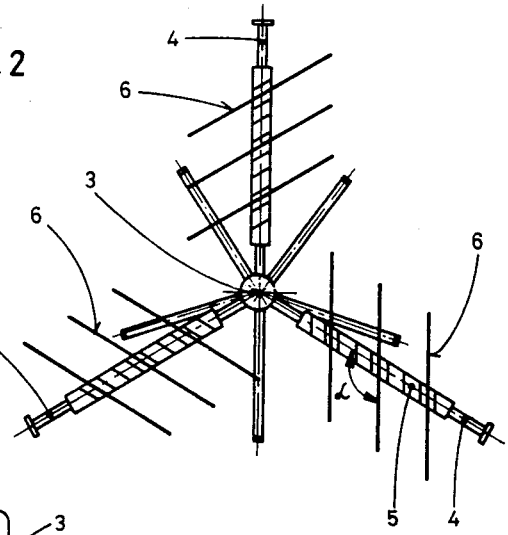
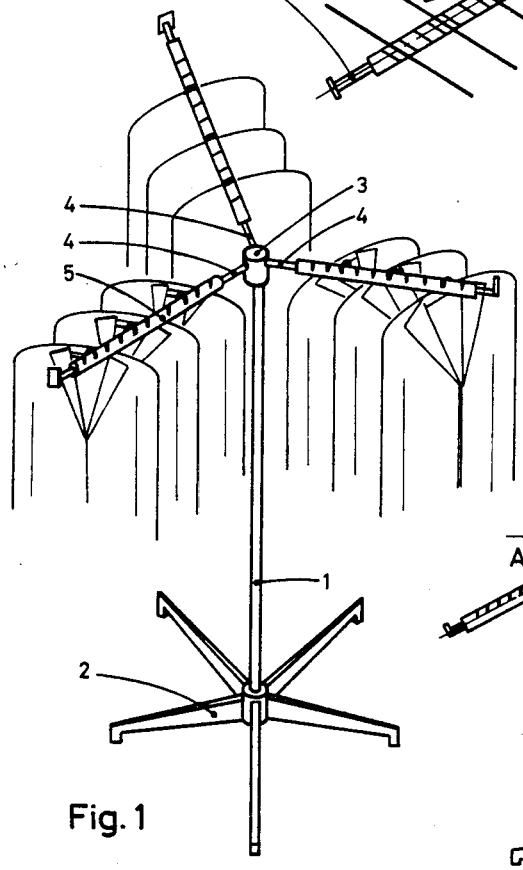
Fig. 1
Fig. 3
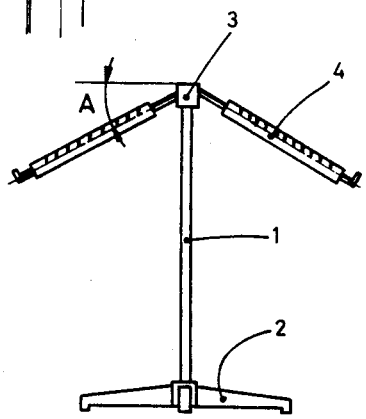

CLOTHES STAND

The present invention relates to a clothes stand.

BACKGROUND OF THE INVENTION

It is known to design multi-arm clothes stands provided for demonstration purposes in shops in such a way that all the articles of clothing suspended on such clothes stands are easily accessible and can conveniently be extracted from a row of clothes and inserted into this again. It is also known, for the purpose of space-saving display of articles of clothing, to suspend these on carrying arms which start from a central supporting column and project essentially radially from this. A disadvantage of this is that in such stands a relatively large surface region of only the foremost article of clothing is usually visible whilst only a narrow sleeve of side portion of the articles of clothing hanging behind it can be seen. Consequently, it is difficult to make a rapid judgment of color or cut to gain a rough idea without swinging out the article of clothing.

Clothes stands of the type with a central column are also known, and although these permit staggered hanging of articles of clothing on clothes hangers, the carrying arms themselves are arranged staggered or extend obliquely. In the latter case, it is possible to influence to a certain extent the pivoting position of the clothes hanger in relation to the longitudinal axis of the carrying arm, but the pivoting which occurs automatically depends both on the inclination of the carrying arm to the column axis and on the cross-sectional shape and the surface quality of the carrying arm.

OBJECTS OF THE INVENTION

The object of the present invention is to provide a clothes stand in which the pivoting of the clothes hanger relative to the longitudinal axis of the carrying arm takes place necessarily over a predetermined angular value in relation to the horizontal, irrespective of the inclination of the carrying arm. Furthermore, a clothes stand is also to be provided, in which the engagement distance between adjacent clothes hangers is provided by means of a relatively narrow grid spacing and the longitudinal displacement of clothes hangers hung with clothes is possible in pivoting positions of the hanger hook not coinciding with the engagement pivoting.

The invention achieves the advantage that a portion of the articles of clothing suspended on the carrying arms of the clothes stand, and not only of the foremost article, which is considerable for the purpose of judging color and cut, is visible without changing the positions of these articles.

BRIEF DESCRIPTION OF THE DRAWING

The invention is described below with reference to an exemplary embodiment according to the drawing in which:

FIG. 1 shows a clothes stand designed according to the invention, with three carrying arms which are mounted on a carrying column in one plane at the same level and at the same angular distance from one another.

FIG. 2 shows the clothes stand according to FIG. 1, seen from above,

FIG. 3 shows, in a side view, a clothes stand with two or more carrying arms inclined outwards and obliquely downwards.

DESCRIPTION OF THE PREFERRED EMBODIMENT

Figure 4B:
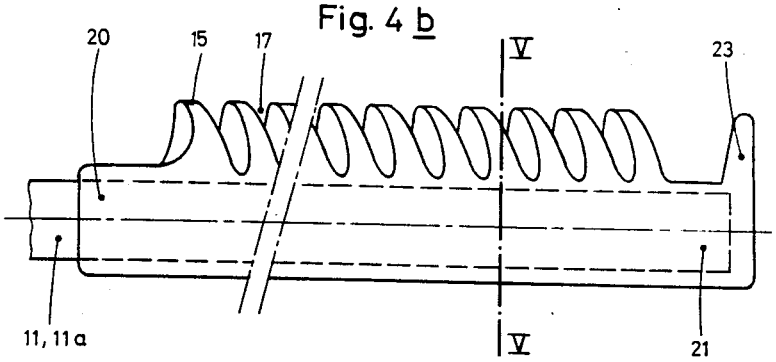
FIGS. 4*a* and 4*b* show, on an enlarged scale, a portion of a carrying arm from above (a) and from the side (b), and FIGS. 5*a*, *b* and *c* show sections along the line V—V in FIGS. 4*a* and *b* with two exemplary embodiments of the core profile of the carrying arm and two embodiments of the bearing comb.
Figure 4A:
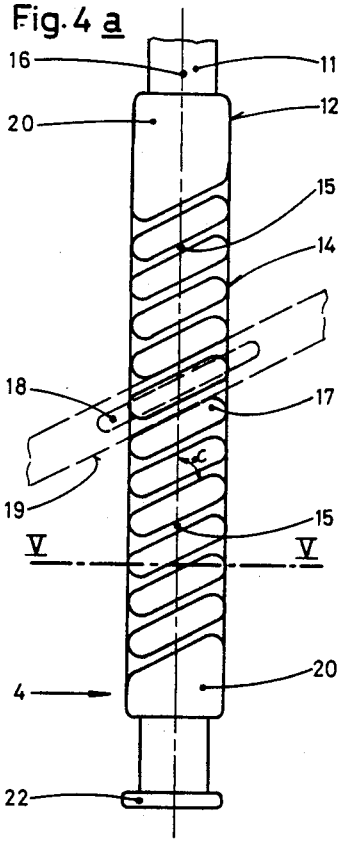

In FIGS. 1 to 3, 1 denotes a supporting column which is placed, for example, on a 5-armed base 2 and which has in the region of its top end a connecting piece 3 for a number of radial carrying arms 4. The connecting piece 3 can be attached to the supporting column 1 fixedly or rotatably. Each of the carrying arms 4 is provided with a support device 5 which spaces the clothes hangers 6 (FIG. 1) from one another according to the invention and which deflects them at an angle $\alpha$ relative to the longitudinal axis of the carrying arm. Details of this are shown in FIGS. 4*a* and *b* and 5*a* to *c*. The carrying arms 4 can be horizontal, as in FIG. 1, or be inclined at an angle A of approximately 5°-30° to the horizontal according to FIG. 3.

According to FIGS. 4*a* and *b* and 5*a* and *b*, the carrying arms 4 are metal profile bars 11, 11*a* anchored in the connecting piece 3 and having a bearing comb 12 which at least partially covers the profile bar and is in the form of a covering structure and which consists of a plastic that can be shaped by injection or casting. According to FIGS. 5*a* and *b*, the bearing comb 12 consists of a tubular portion 13 surrounding the profile bar 11, 11*a* in the manner of a sleeve and of a comb portion 14 connected in one piece to this tubular portion. The comb portion contains a number of comb teeth 15 which are inclined at an angle $\alpha$ of approximately 60°±5° relative to the longitudinal axis 16 of the carrying arm. The comb teeth 15 are parallel to one another at distances of 10±2 mm and limit grooves 17 for receiving the suspension hooks 18 on the clothes hangers 19 which are shown by broken lines in FIG. 4*a*. The grooves 17 have a U-shaped to slightly V-shaped profile, depending on whether the carrying arm is arranged horizontally or inclined obliquely downwards. In the latter case, the groove-profile axes are essentially vertical, so that a practically jamming-free support is obtained for the clothes-hanger hooks 18. At both ends of the comb portion 14 provided with comb teeth 15, the tubular portion 13, is provided with end sleeves 20, the length of which can be selected both according to aesthetic criteria and according to the desired coverage of the metal profile bar 11, 11*a*.

The outer end of the metal profile bar 11, 11*a* is appropriately provided with a plate-shaped closing element 22 (FIG. 4*a*) which, in the case of a tubular profile bar 11, can be shaped onto the end of a plug (not shown) which can be inserted into the tube orifice. Optionally, an end bead 23 (FIG. 4*b*) shaped on a radially outer end cap 21 can be provided instead of the plate-shaped closing element 22.

Figure 5A:
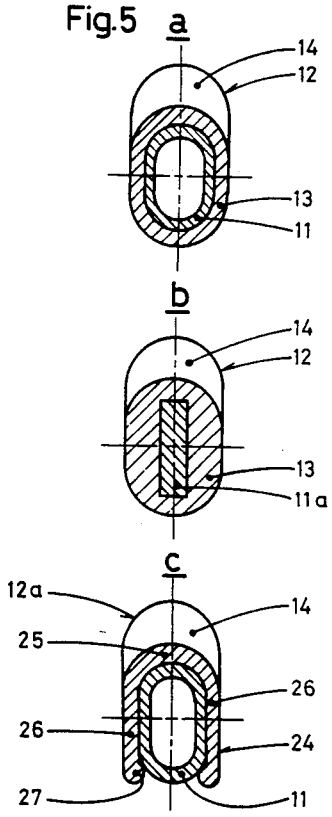

The bearing comb covering the metal profile bar 11, 11*a* at least partially can be provided, according to FIG. 5*c*, with, instead of the tubular portion 13 (FIGS. 5*a* and *b*) surrounding it in the manner of the sleeve, a clamping channel 24 in the form of an upturned U, on the base web 25 of which the comb portion 14 is attached as described above. A bearing comb 12*a* designed in this way is simply attached astride onto the metal profile bar 11, 11*a*. The side walls 26 of the clamping channel 24 are appropriately designed so that, when the bearing comb 12*a* is assembled, they exert a snap-in clamping effect on the metal profile bar 11. For this purpose end beads 27 can be shaped on the longitudinal edges of the side walls 26.

The comb teeth 15 extending parallel to one another at a distance of 10±2 mm and arranged at an angle $\alpha$ of 60°±5° to the longitudinal axis 16 of the carrying arm constitute, for suspension hooks 18 on the clothes hangers 19 which are at an angle of 90° to the longitudinal axis 16 or less (counter to the inclination of the grooves 17), a more or less corrugated flat bearing zone on which the suspension hooks 18 can be displaced longitudinally. Consequently, when clothes hangers 19 provided with articles of clothing are attached to this carrying arm in such an angular relationship, they are freely displaceable along the carrying arm 4 until they are brought into the angular relationship $\alpha$ for engagement, in which the suspension hook 18 engages into the groove 17 and, as a result, both the hanging point on the carrying arm 4 and the inclination of the clothes hanger are fixed.

I claim:

1. A clothes stand comprising a plurality of carrying arms fastened to a supporting arrangement, said carrying arms on their upper side being provided with a bearing portion for spacing apart several articles of clothing hanging on clothes hangers on each carrying arm, said bearing portion being provided with a plurality of comb teeth positioned at an angle of about 60° to a longitudinal axis of said carrying arm, said teeth being located parallel to one another at a distance of about 10 mm, said teeth having an upper portion being curved convexly in a transverse direction of the carrying arm and having substantially straight configuration in a longitudinal direction thereof, comb grooves located between said comb teeth, said comb grooves being adapted to receive hooks of said clothes hangers in such a way that the upper portions of the successive comb teeth in the longitudinal direction of the carrying arm form continuous bearing zone for the hooks of said clothes hangers which are disposed at an angle of at most 90° to a longitudinal axis against the angle of inclination of the comb teeth, and wherein a distal end of the bearing portion is formed as a radially outer end cap which is provided with an end bead formed integrally with said outer end cap.

* * * * *